US006705398B2

(12) United States Patent
Weng

(10) Patent No.: US 6,705,398 B2
(45) Date of Patent: Mar. 16, 2004

(54) FRACTURE CLOSURE PRESSURE DETERMINATION

(75) Inventor: Xiaowei Weng, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/178,492

(22) Filed: Jun. 24, 2002

(65) Prior Publication Data

US 2003/0079875 A1 May 1, 2003

Related U.S. Application Data

(60) Provisional application No. 60/310,214, filed on Aug. 3, 2001.

(51) Int. Cl.[7] ..... E21B 47/06; E21B 43/26

(52) U.S. Cl. ..... 166/250.1; 166/250.07

(58) Field of Search ..... 166/250.1, 308, 166/250.07; 73/152.51, 152.54

(56) References Cited

U.S. PATENT DOCUMENTS

| | | | | | |
|---|---|---|---|---|---|
| 4,372,380 | A | | 2/1983 | Smith et al. | 166/250 |
| 4,836,284 | A | * | 6/1989 | Tinker | 166/279 |
| 5,050,674 | A | | 9/1991 | Soliman et al. | 166/250 |
| 5,275,041 | A | | 1/1994 | Poulsen | 73/155 |
| 5,305,211 | A | | 4/1994 | Soliman | 364/422 |
| 6,364,015 | B1 | * | 4/2002 | Upchurch | 166/250.1 |

FOREIGN PATENT DOCUMENTS

| | | | | |
|---|---|---|---|---|
| CA | 1185170 | | 4/1985 | E21B/49/00 |
| EP | 0476758 | * | 3/1992 | E21B/49/00 |

OTHER PUBLICATIONS

Holzhausen G.R., *Impedance of Hydraulic Fractures: Its Measurement and Use For Estimating Fracture Closure Pressure and Dimensions*, SPE 13892 Low Permeability Gas Reservoirs held in Denver, Colorado, May 19–22, 1985.

Chapter 9, *Reservoir Stimulation*, 3rd Edition, Economides & Nolte eds., John Wiley & Sons, 2000.

Rutqvust, J. and Stephansson, O., "A Cyclic Hydraulic Jacking Test to Determine the In Situ Stress Normal to a Fracture," Int. Journal of Rock Mechanics and Mining Sciences & Geomechanics Abstracts 33, Nov. 7, 1996.

Plahn, S.V., Nolte, K.G., Thompson, L.G.and Miska, S., "A Quatitative Investigation of the Fracture Pump–In/Flowback Test," SPE 30504, SPE ATCE, Dallas, Oct. 1995.

Wright, C.A., Weijers, L., Minner, W.A., Snow, D.M., "Robust Technique for Real–Time Closure Stress Determination," SPE Production and Facilities, Aug. 1996.

(List continued on next page.)

*Primary Examiner*—William Neuder
(74) *Attorney, Agent, or Firm*—Catherine Menes; Thomas O. Mitchell; Brigitte Jeffery

(57) ABSTRACT

A method for assessing the fracture pressure closure is proposed. This method includes first injecting a fluid into the formation at a first generally constant rate Q to create a fracture, and then, dropping the pumping rate to significantly smaller feed rate q so that the volume of the fracture becomes constant, in other words. As the fracture volume becomes constant at equilibrium, the well is shut-in. The wellbore pressure is monitored and the closure pressure is determined from the analysis of the wellbore pressure using a time-function of the dimensionless "shut-in" time, defined as the ratio of time since shutting to pumping time. This method provides a way of estimating the friction component of the monitored wellbore pressure due to the fracture tortuosity and friction.

It is applicable to the art of fracturing subterranean formations and more particularly to the process of designing and analyzing stimulation treatments.

17 Claims, 4 Drawing Sheets

OTHER PUBLICATIONS

Upchurch, E.R., "Determining Fracture Closure Pressure in Soft Formations Using Postclosure Pulse Testing," SPE 56723, SPE ATCE, Houston, Oct. 1999.

Mukherjee, H. and Paoli, B.F., "Successful Control of Fracture Height Growth by Placement of Artificial Barrier", SPE 25917, SPE Rocky Mountain Regional/Low Permeability Reservoirs Symposium, Denver, Apr. 1993.

Nolte, K.G., "Fracturing Pressure Analysis for Non–ideal Behavior," JPT, Feb. 1991, p210.

Nolte, K.G., "Determination of Fracture Parameters From Fracturing Pressure Decline," SPE 8341, SPE AIME, Dallas, Sep. 1979.

* cited by examiner

FRACTURE CLOSURE PRESSURE DETERMINATION

REFERENCE TO RELATED PROVISIONAL APPLICATION

This application claims the benefit of U.S. Provisional Application Serial No. 60/310,214 filed Aug. 3, 2001.

TECHNICAL FIELD OF THE INVENTION

This invention relates to the art of fracturing subterranean formations and more particularly to a method for determining fracture pressure closure and other parameters used in the process of designing and analyzing stimulation treatments of subterranean formations such as fracture treatments.

BACKGROUND OF THE INVENTION

Hydraulic fracturing is a primary tool for improving well productivity by placing or extending channels from the wellbore to the reservoir. This operation is essentially performed by hydraulically injecting a fracturing fluid into a wellbore penetrating a subterranean formation and forcing the fracturing fluid against the formation strata by pressure. The formation strata or rock is forced to crack and fracture. Proppant is placed in the fracture to prevent the fracture from closing and thus, provide improved flow of the recoverable fluid, i.e., oil, gas or water.

A proper design of a fracturing treatment is a complex engineering discipline. The post-fracture production depends on multiple factors such as the reservoir permeability, porosity, pressure, injections rates and properties of the injected fluids. Among those factors, one of the most critical is the closure pressure, also called the minimum in-situ rock stress. The closure pressure is defined as the fluid pressure at which an existing fracture globally closes. The closure time is the time when the fluid in the fracture is completely leaked off into the formation and the fracture closes on its faces. The closure pressure forms the basis of all fracture analysis, and in particular of the pressure decline analysis. It is also used for proppant selection. Incorrect closure pressure could lead to incorrect interpretation of fluid efficiency and thus improper pad fluid volume, which could result in job failure or poorer hydrocarbon production.

Field procedures are routinely performed to estimate the closure pressure and other relevant parameters such as the in-situ fluid efficiency and leak-off coefficient. These procedures involve a calibration test or mini-frac. A mini-frac is an injection/shut-in/decline procedure. The designed viscosified fractured fluid (without proppant) is injected into the target formation at a constant rate for a period a time. Then, the well is shut in and a pressure decline analysis is performed. The mini-frac is essentially used for determining the fracture half-length, the fracture width, the fracture height, the fluid-loss coefficient, the formation's Young's modulus and the fluid efficiency. The fracture closure can also be identified from the decline curve as slope changes. However, other events such as fracture height recession and multiple permeable layers could lead to multiple points of slope change. In many cases, such as in naturally fractured formations with pressure dependent leak-off, the decline curve exhibits a gradual change of slope which makes picking the correct closure pressure difficult. For these reasons, different engineers often arrive at different closure pressures, leading to inconsistent or erroneous interpretations.

Separate closure tests have therefore been developed to specifically determine the closure pressure.

The most commonly used closure test technique is the step rate, generally performed with completion fluids or water. The thin fluid is injected into the target formation at increasing rates, ideally including both matrix rates and fracturing rates if possible. The matrix rates correspond to the flow into the formation before the fracture is opened, and fracturing rates are those that induce a pressure above the closure pressure so the fracture is opened and extended. A stabilized pressure is determined from the pressure record for each rate. The pressure is plotted against the flow rate. The ideal response will show data points falling approximately on two straight-line sections. The first straight line corresponds to the matrix flow at lower rates and has a steeper slope because a small rate increase will cause a relatively large pressure increase. The second straight line corresponds to the fracturing at higher rates and has flatter slope since once the fracture is opened, the fracturing pressure is much less sensitive to the flow rate. The intersection of the two lines is the fracture extension pressure, reflecting the minimal rate required to hydraulically extend a fracture. The extension pressure is an upper bound of closure pressure and often used as a direct approximation of closure pressure. Closure pressure can also be estimated from the intercept of the fracture extension line with the y-axis (corresponding to zero pump rate).

The step rate test can be affected by tubing friction and near-wellbore fracture "tortuosity". The fracture tortuosity is the added pressure caused by various near-wellbore restrictions such as tortuous flow path through a micro annulus between cement and rock, limited number of perforations connecting with the fracture, multiple fracture branches, fracture reorientation as it propagates away from wellbore, etc. The tortuosity causes the measured pressure to be higher than the pressure inside the fracture and is rate dependent. As a result, the extension pressure determined from the step rate test includes a friction/tortuosity component. For high permeability reservoir, for which the extension rate is relatively high, the friction component is quite significant, making the extension pressure much greater than the closure pressure. Furthermore, both tubing friction and tortuosity are rate dependent and increase as rate increases. They may affect the pressure vs. rate plot in such a way that either the extension portion does not fit on a straight line or the slope is different from what should have been. The data points may therefore be dramatically altered, leading to interpretation errors.

Pump-in/flowback is another technique that has been used to determine closure pressure. After a period of injection, instead of shutting the well in, the fluid is flown back to surface-at a constant-rate. The pressure decline curve has a characteristic S-shape, changing from concaving upward (after the initiation of flow back, when the fracture is still open) to concaving downward (after fracture closure, when the pressure drops rapidly). The point of inflexion of the S-shaped curve yields an estimate of the closure pressure. When flowback ceases, the wellbore pressure recovers and reaches a plateau, which is called rebound pressure. The rebound pressure provides another approximation (usually a lower bound) of the closure pressure.

Though it looks attractive, the pump-in/flowback test is not widely used in the field. This is mainly due to the inconvenience of having to rig up a flowback line with an adjustable choke to keep the flowback rate constant. The adjustable choke has to be calibrated to determine the pressure reading corresponding to the flowback rate, and has to be manned during the flowback to maintain a constant rate.

Another technique that has been used to determine closure pressure is injection pulses during the pressure decline (i.e. shut-in period). A small volume of fluid is intermittently injected. At each injection, the wellbore pressure will exhibit a pressure pulse. The pulse will quickly dissipate and the pressure fall back to the normal decline curve if the fracture is still open. If the fracture is closed, the pulse will dissipate slower and the pressure will have a shift above the normal decline curve. Since the pulses are sparse, the pulses at best can bound the closure point between two consecutive pulses. The method cannot give an exact determination of the closure pressure. Furthermore, the pulses contaminated the normal decline behavior so that the determination of decline slope and leak-off properties may be compromised.

The present invention provides a new procedure for determining the fracture closure pressure of a full-scale fracture treatment of a subterranean formation.

SUMMARY OF THE INVENTION

The method of the present invention comprises injecting a fluid into the formation at a first generally constant rate Q to create a fracture having a volume, and dropping the pumping rate to significantly smaller feed rate q so that the volume of the fracture becomes constant, in other words, the injection and leak-off reach equilibrium. As the fracture volume becomes constant at equilibrium, the well is shut-in. The wellbore pressure is monitored and the closure pressure is determined from the analysis of the wellbore pressure using a time-function of the dimensionless "shut-in" time $\Delta t_D$. According to preferred embodiment of the present invention, this function is based on the square-root of-the dimensionless "shut-in" time $\Delta t_D$.

The small rate q should be less than the fluid leak-off rate in the fracture at the time of rate drop. The initial constant rate is preferably the expected fracturing rate of the full-scale treatment. According to a preferred embodiment, the rate ratio q/Q is preferably less than 0.2.

As a result of the injection rate decrease, the wellbore pressure initially declines as more fluid is leaked off into the formation than is injected in. The fluid leak-off decreases with time, and when the fracture approaches closure, the injection and leak-off reach equilibrium. As the fracture volume becomes constant at the equilibrium, the pressure levels off, which can be easily identified. From the measured pressure at the initial rate drop and at the equilibrium, the closure pressure can be estimated. The pressure drop at shut-in reflects the tortuosity and friction effects corresponding to the small injection rate. The estimated closure pressure can thus be corrected to account for tortuosity and friction. The method is operationally easy to implement in the field.

Additionally, with a modified time function that replaces the conventional G-function, the ideal decline curve becomes a straight line, and the slope is the same as the conventional G-plot. From the slope, the leak-off coefficient can be determined.

DETAILED DESCRIPTION AND PREFERRED EMBODIMENTS

Figure 1:
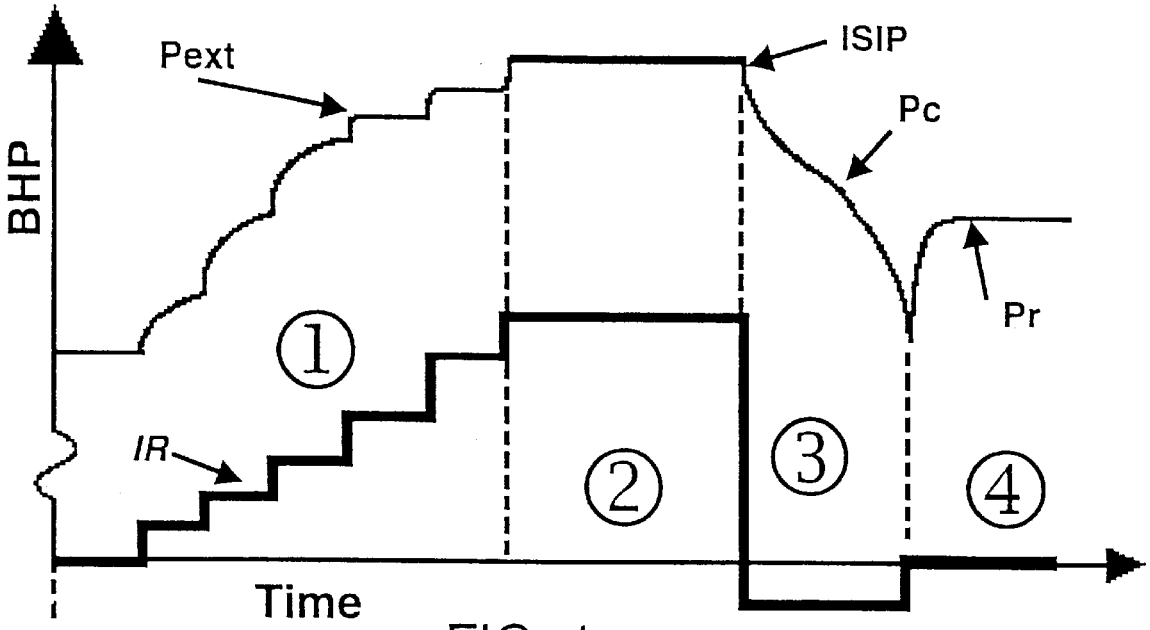
FIG. 1 (Prior Art)
FIG. 1 shows the bottomhole pressure versus time plot in a typical step rate closure test.

As discussed above, a preferred conventional closure test technique is based on a step rate test, or more specifically, on a step rate followed by a flowback and a pressure rebound. A typical pressure response of the closure test is illustrated in FIG. 1. In this figure, the fluid rate is represented by the step curve IR. In phase ①, a fluid is injected at increasing rates. During that phase, the injection rate reaches a point where the bottomhole wellbore pressure exceeds the fracture extension pressure Pext but in most cases, the operator will continue to increase the rate according to the schedule. In phase ②, pumping continues at the same rate for five to ten minutes after fracture extension. In phase ③, the injection is stopped and the valve opened for immediate starting of the flowback (negative injection rate). At the closure pressure Pc, the pressure response shows a distinct reversal in curvature upon closure has occurred, indicating a change of fluid withdrawal from the open fracture to withdrawal through the matrix. Finally, in phase ④, the shut-in is completed and the rebound pressure Pr after shut in serves as a lower bound to closure pressure.

Figure 2:
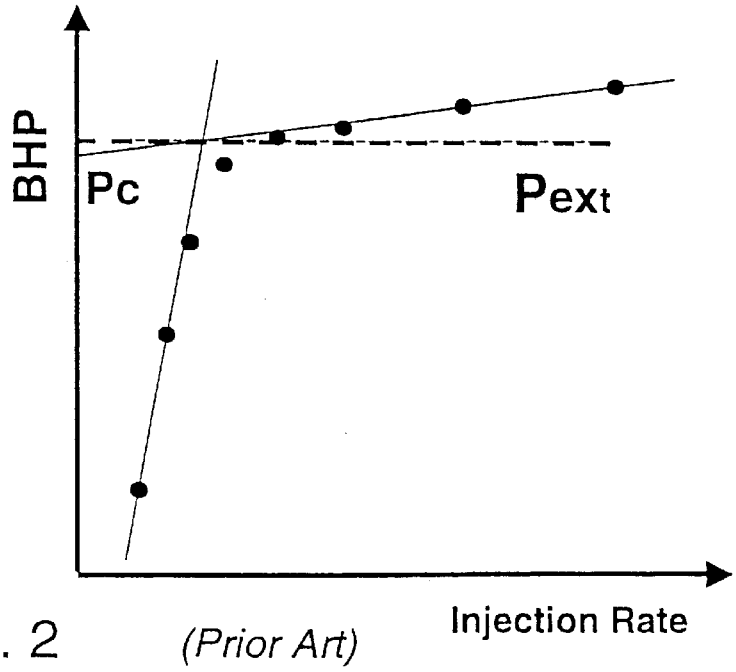
FIG. 2 (Prior Art)
FIG. 2 shows the bottomhole pressure versus injection rate in a typical step rate closure.

As shown in FIG. 2, the bottomhole pressure versus rate plot will show two slopes. The intersection of the two slopes indicates fracture extension pressure Pext. The change of slope is a result of different pressure responses for matrix leak-off at low pump rate and fracture extension at the higher pump rate. The extension pressure is usually 50 to 200 psi greater than the closure pressure because of fluid friction in the fracture and fracture toughness, though far greater differences have been observed. An estimate of closure pressure Pc is obtained from the intercept of the fracture extension slope line with the y-axis (zero pump rate).

More accurate determination of the closure pressure can be obtained from the flowback portion of pressure response. The rebound pressure further provides a lower bound of the closure pressure. However, the flowback test is seldom done in the field since it requires rigging up a flow-back loop with flow regulator or adjustable choke to maintain a constant flowback rate.

A simple shut-in/decline is often opted in lieu of flowback. To yield closure pressure, the shut-in decline data can be analyzed by plotting the bottomhole pressure versus a time function of the shut-in-time, most often a function called the G-function. However, the shut-in decline data is often difficult to analyze and could yield inaccurate closure pressure. This is because the decline curve can exhibit multiple slope changes, or continuously changing slopes due to a smooth transition (fracture face consolidation) from fracture behavior prior to the closure to reservoir diffusion behavior after the closure.

The fracture closure pressure is further complicated by the fact that the extension pressure determined from the step rate test contains a tortuosity component that is rate dependent and increases as rate increases. It thus affects the step rate test result (pressure vs. rate plot) and increases the apparent fracture extension pressure. It could also alter the data points in such way that the extension portion does not fit on a straight line or the slope is different from what should be, leading to interpretation errors. Similarly, tubing friction may introduce interpretation errors since only surface pressure is measured in majority of cases and the calculated bottomhole pressure is usually not accurate at higher rates due to errors in friction calculation.

Another factor that affects the step rate interpretation is the inhomogeneous nature of the reservoir. The fracturing interval often contains multiple sub layers. The fracture opened up initially at low rate may only cover a portion of the zone, and the zone coverage increases as the rate increases. This causes a more gradual transition from matrix flow slope to fracture extension, contributing to uncertainty in the extension and closure pressure determination. The tortuosity also affects the flowback test, causing the closure pressure to be lower than the actual value, since the flow direction is the reverse of injection.

The invention proposes a new way of determining closure pressure by decline analysis with continuous injection at a small rate q during the pressure decline period. This method, called "equilibrium test" is illustrated FIG. 3 that shows the evolution of the fluid flow rate (bottom step curve in dotted line) and the bottomhole pressure (upper solid curve) versus time.

During the first stage of the equilibrium test, the fluid is injected at a pumping rate Q. Right after the pump rate step down, the wellbore pressure is equal to $P_{sd}$. Instead of shutting down the injection, the pump rate Q is dropped to a small rate q to continue feeding the fluid into the fracture. This rate is much smaller than the main injection rate Q in the step rate test (normally in the order of 10–15 bpm) and generally, a rate ratio q/Q of less than 0.2 is preferred.

The treating pressure initially declines as in the conventional shut-in decline, because the small rate q is much smaller than the main injection rate Q, and as such is usually less than the fracture leak-off rate as well at the time of rate drop. The fracture volume and the pressure decrease with time as more fluid leaks off than is injected. When fracture volume is sufficiently reduced, the fracture length may also recede as the fracture approaches closure. The leak-off rate decreases with time and eventually to the point that the leak-off rate and the injection rate q become equal. After that, the fracture volume does not decrease any further and the wellbore pressure flattens out to a value and then, starts increasing, since the leak-off rate continues to decrease with time while the injection rate remains constant. The minimum pressure when rate equilibrium is reached is called the equilibrium pressure $P_{eq}$. The time when equilibrium pressure is reached is $t_{eq}$ (all times are computed from the beginning of the injection at the high rate Q, so that as shown FIG. 3, the equilibrium time $t_{eq}$ does also include the pumping time $t_p$ at the high injection rate Q). Once the equilibrium is reached, the well can be shut in. The pressure drop at the final shut-in is $\Delta P_{si}$ and the test is completed.

A main difference between pressure response of an equilibrium test and that of conventional shut-in decline is that the pressure stays above the closure pressure until after the final shut-in, if the small injection rate q is properly selected so that it is greater than the matrix leak-off rate. The rate equilibrium is easy to identify from the pressure signature and is unique, avoiding the ambiguities associated with the conventional shut-in decline where multiple slope changes could be encountered.

For the fracture to be still at least partially open when the equilibrium is reached, the small injection rate q needs to be greater than the matrix injection rate. If the fracture extension rate is known from prior step rate test done in the well or in the same field, then q can be selected the same as or greater than the estimated extension rate. For a high permeability formation with high leak-off, the fracture extension rate can be relatively high. In this case, the equilibrium test could be done after a minifrac, which uses a cross-linked fluid that forms filter cake on the fracture face and reduces the fluid leak-off.

The fluid volume pumped during the main injection stage at rate Q needs to be sufficient to create a fracture in the zone of interest. On the other hand, large volumes may not only increase fluid cost but also the time to reach equilibrium.

The time needed to reach the equilibrium can vary considerably from well to well based on the observations in the field tests. It is a function of injection rate, leak-off rate and fracture volume. A relatively high q and small-fracture volume (short main injection stage) will likely result in reaching equilibrium fairly quickly. But getting to equilibrium too quickly may sometimes affect the analysis. One of the problems is picking the instantaneous step down pressure, Psd, and determining the decline slope, when there is a great deal of pressure fluctuation right after the rate step down (water hammer effect). Picking the $P_{sd}$ after the pressure oscillation dies down may result in a $P_{sd}$ that is too low and leads to error in the calculated closure pressure. If this problem exists, one may need to reduce the small rate q, and/or increase the fracture volume (i.e. increase pump time at the main pump rate Q).

For a tight formation, it may take a long time to reach equilibrium, just as in conventional shut-in decline where a long closure time is expected. In this situation, the pressure decline may take place very slowly as the fracture approaches equilibrium condition, which may give a false impression that the equilibrium has been reached when it is not. The real-time display of modified G-function plot will help identify the change in pressure trend and determine whether the equilibrium has been reached.

Figure 4:
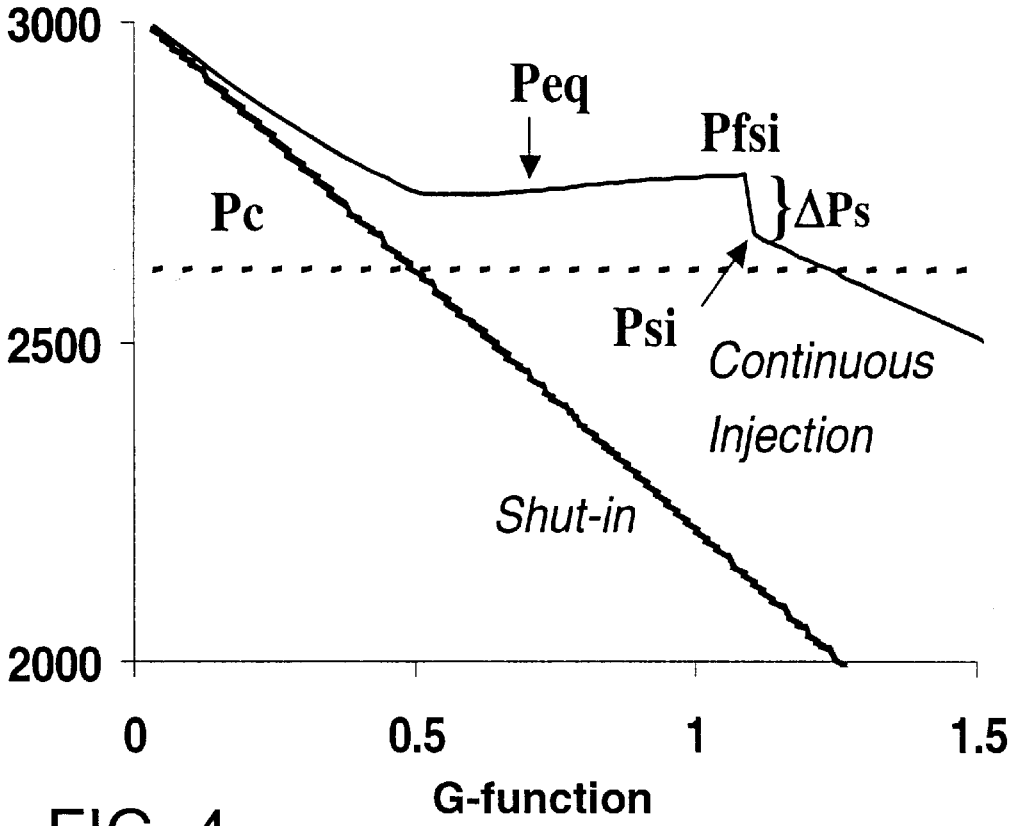
FIG. 4 shows the wellbore pressure versus the G-function in a continuous low-rate injection test according to the invention.

Immediately after the pump rate drops to the small feed rate, the leak-off rate in the fracture is normally much larger than the feed rate. Therefore, the pressure in the fracture is expected to decline in a similar fashion as in conventional shut-in/decline test. This is illustrated as the initial decline portion of the continuous injection curve in FIG. 4 where the wellbore pressure Pw is plotted versus the G-function defined by Nolte in "*Determination of Fracture Parameters from Fracturing Pressure Decline*", in paper SPE 8341 presented at the Society of Petroleum Engineering Annual Conference and Exhibition, Las Vegas, USA (Sep. 23–26, 1978). The G function is expressed in Equation (1) in terms of the dimensionless shut-in time $\Delta t_D$ which is defined as the ratio of time since shutting to pumping time $t_p$:

$$\Delta t_D = \Delta t / t_p = \frac{t - t_p}{t_p}.$$

$$G(\Delta t_D) = \frac{4}{\pi}[g(\Delta t_d) - g_0] \qquad \text{Equation (1)}$$

Where $$g(\Delta t_D, \alpha) = \begin{cases} (1+\Delta t_D)\sin^{-1}(1+\Delta t_D)^{-1/2} + \Delta t_D^{1/2} & \alpha = 1/2 \\ \frac{4}{3}((1+\Delta t_D)^{3/2} - \Delta t_D^{3/2}) & \alpha = 1 \end{cases}$$

And $$g_0(\alpha) = \begin{cases} \pi/2 & \alpha = 1/2 \\ 4/3 & \alpha = 1 \end{cases}$$

The exponent α is the log—log slope of the total fracture area at a time t versus t. The value of α depends on the fluid efficiency and generally decreases throughout the injection time as the leak-off decreases due to the formation of the filter-cake. The bounding values of α for a wall-building fluid are ½ and 1, most common fracturing fluids have a value close to 0.6. In practice, it should be noted that the G-equation leads essentially to the same results when α varies between its bounding limits so that the computation may be done using either value or the average resulting value.

Figure 3:
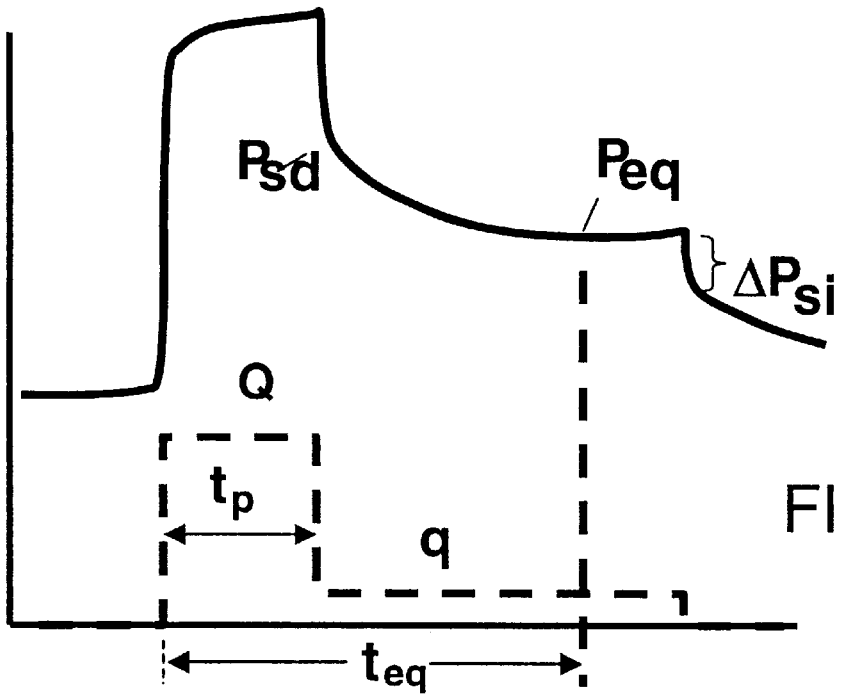
FIG. 3 shows the bottomhole pressure versus time plot, and the corresponding injection rate in the equilibrium test according to the invention.

To be noted that the FIG. 3 is for illustration purpose only, not real data. The slope of the decline is less than the corresponding slope of a shut-in decline due to the injection. As the fracture approaches closure, the fracture length recedes and will eventually stabilize when the leak-off balances the small injection. With the injection rate greater than the matrix rate, it is expected that the fracture is kept partially open by the injection. This means the wellbore pressure will flatten out as the injection and leak-off reach equilibrium. The corresponding pressure, denoted as Peq, should be above the closure pressure Pc.

A low viscosity fluid is generally preferred for the equilibrium test. With a low viscosity fluid, the net pressure in the fracture is small and hence increases the accuracy of the closure pressure estimate. For instance, the fluid can be a linear gel or KCl water as generally used for flush fluid. If the formation has high permeability and hence high leak-off so that a relatively large q has to be used, then a fluid with less leak-off (maybe higher viscosity) may be considered. A delayed cross-linked gel may not be a good choice since it may cause friction pressure change with time due to rheology change taking place in the tubing during the small rate injection.

Since the injection rate is small and a low viscosity fluid is used, the net pressure in the fracture should also be small. Therefore, the equilibrium pressure provides a direct approximation of the closure pressure.

However, like the extension pressure in the step rate test, Peq contains a friction component due to fracture tortuosity and friction. According to a preferred embodiment of the present invention, this tortuosity/friction component can be estimated from the pressure drop at the final shut-in, shown as ΔPsi in FIG. 4. The closure pressure can thus be estimated as Peq−ΔPsi, or the final shut-in pressure Psi. The flattening of the pressure curve provides a distinctive indication of fracture approaching closure and thus eliminate the uncertainty in the conventional shut-in decline analysis where the pressure continues to decline after closure and the slope could be increasing, decreasing or staying the same, depending on reservoir behavior.

A derivation of pressure decline function similar to the conventional G-function analysis is carried out for square root leak-off (Newtonian fluid). The pressure decline can be shown to have the following expression:

$$p_{ws} - p_w(\Delta t_D) = p^*\left[G(\Delta t_D) - \frac{q}{Q(1-\eta)}\frac{4\kappa g_0}{\pi}\Delta t_D\right] \qquad \text{Equation (2)}$$

where p* is the characteristic decline pressure, $$p^* = \frac{\pi r_p C_L \sqrt{t_p}}{2c_f}$$

Equation (2) differs from the conventional shut-in decline by the second term in the bracket, where Q is the injection rate during the main pumping phase, q is the small feed rate, η is the fluid efficiency at the end of the main pumping phase, κ is the spurt factor (κ=1 if spurt is negligible), and $\Delta t_D = t/t_p - 1$ is the dimensionless "shut-in" time. With fluid efficiency typically low for low viscosity fluid and κ=1, equation (2) can be further reduces to Equation (3):

$$p_{ws} - p_w(\Delta t_D) = p^*\left[G(\Delta t_D) - \frac{q}{Q}2\Delta t_D\right] \qquad \text{Equation (3)}$$

Since q/Q is small, the second term is generally much smaller than the G-function. If we introduce a function $G'(\Delta t_D)$ that equals to the expression in the bracket, then the plot of $p_w$ vs. G' is a straight line, and the slope is the same as the slope in the conventional G-plot, i.e. the p*. This is illustrated FIG. 5.

Even though Peq−ΔPsi, or shut-in pressure Psi, provides an approximation of the closure pressure, it is still larger than the true closure pressure, due to a finite net pressure associated with the injection. However, if the net pressure in the fracture can be estimated, the closure pressure can be more accurately determined by subtracting the net pressure.

For a regular fracture (fracture length greater than fracture height), analytical study shows that the ratio of the net equilibrium pressure, $P_{net,eq}$, to the net pressure immediately after the rate step down (i.e. at $t=t_p$), $P_{net,sd}$, satisfies the following equation:

$$\lambda = \frac{P_{net,eq}}{P_{net,sd}} = \left(\frac{q}{Q}\right)^{1/2}\left(\frac{n+3}{n+2}\frac{2n+2}{2n+3}\right)\left(\frac{\pi}{(n+2)}\frac{\kappa}{1-\eta}(t_{eq}/t_p)^{1/2}\right)^{1/(2n+2)} \qquad \text{Equation (4)}$$

where $t_{eq}$ is the time when equilibrium is reached, n is the power-law index of the fluid being injected, κ is the spurt factor$_1$ (κ=1 when the spurt is negligible), and η is the expected fluid efficiency.

For a Newtonian fluid (n=1), the above equation becomes $$\lambda = \frac{P_{net,eq}}{P_{net,sd}} = 1.08\left(\frac{q}{Q}\right)^{1/2}\left(\frac{\kappa}{1-\eta}\sqrt{t_{eq}/t_p}\right)^{1/4}. \qquad \text{Equation (5)}$$

For a very short or radial fracture, the pressure reaches a minimum before the injection rate q becomes equalized with the leak-off. This is due to the fact that the net pressure decreases as the fracture length or radius increases, and conversely the decrease in fracture length or radius leads to pressure increase. After the pump rate drops from Q to q, the fracture volume gradually decreases due to fluid leak-off being greater than injection rate q, and so does the net pressure. When the net pressure in the fracture decreases to the point that it is equal to the frictional pressure drop in the fracture associated with injection rate q, the net pressure cannot decrease any further. In that case, the net pressure ratio λ can be approximated by the following equation:

$$\lambda = \frac{P_{net,eq}}{P_{net,sd}} \approx \left(\frac{q}{Q}\right)^{n/(2n+2)} \qquad \text{Equation (6)}$$

The ratio λ is generally much less than 1. Using Equation (4) or (6), the closure pressure Pc can be estimated from Peq and the pressure immediately after the rate drop Psd via the following equation (8):

$$P_c = P_{eq} - \Delta P_{si} - (P_{sd} - P_{eq})\frac{\lambda}{1-\lambda} \qquad \text{Equation (7)}$$

where $\Delta P_{si}$ is the pressure drop due to tortuosity and friction which is determined from the pressure change at the final shut-in.

As has been emphasized in the discussion above, the small feed rate q during decline must be above the matrix rate so the fracture is kept partially open. This rate can be selected as the fracture extension rate as determined from the step rate test or slightly above. The continuous injection test could also be done after the calibration test with viscous gel. It is preferable to do so especially for higher permeability reservoir where fluid leak-off and hence matrix rate are high. After pumping the calibration test, the leak-off through the fracture face is significantly reduced by the gel filter cake. The "matrix" flow is significantly impaired and a small rate will cause the fracture to be opened.

The proposed method of small injection during pressure decline provides an alternative method for determining closure pressure. It provides a more easily identifiable fracture closure signature than the conventional shut-in decline, while it can be easily carried out in the field without special rig up as in the case of pump-in/flowback test. Easy identification of fracture closure also allows field personnel to be able to immediately proceed to the main fracture treatment, without extended shut-in time in order to capture the post closure pressure behavior for proper closure identification and decline analysis. It also provides a means to correct for the near-wellbore tortuosity using the final shut-in pressure.

One drawback of the method is that if the feed rate during the decline is too low (below the minimum rate to maintain an open fracture), the equilibrium pressure could fall below the closure pressure and significant error could result. Therefore, it is preferable to have the continuous injection test done after the step rate test to select the feed rate above the matrix rate, or have the test done after a calibration test so that a small rate is sufficient to keep the fracture partially open due to reduced leak-off by gel filter cake on the fracture face.

Field Cases

Field Case #1

The formation being fractured is a sandstone formation at a depth of 9056'–9191' with net height of 115'. Formation permeability is 0.07 md. The treatment schedule consists of loading the hole and ball out, an equilibrium test, a pump-in test called FET carried out in the regular jobs that consists of step-down test and shut-in decline, and the main proppant frac.

Figure 6:
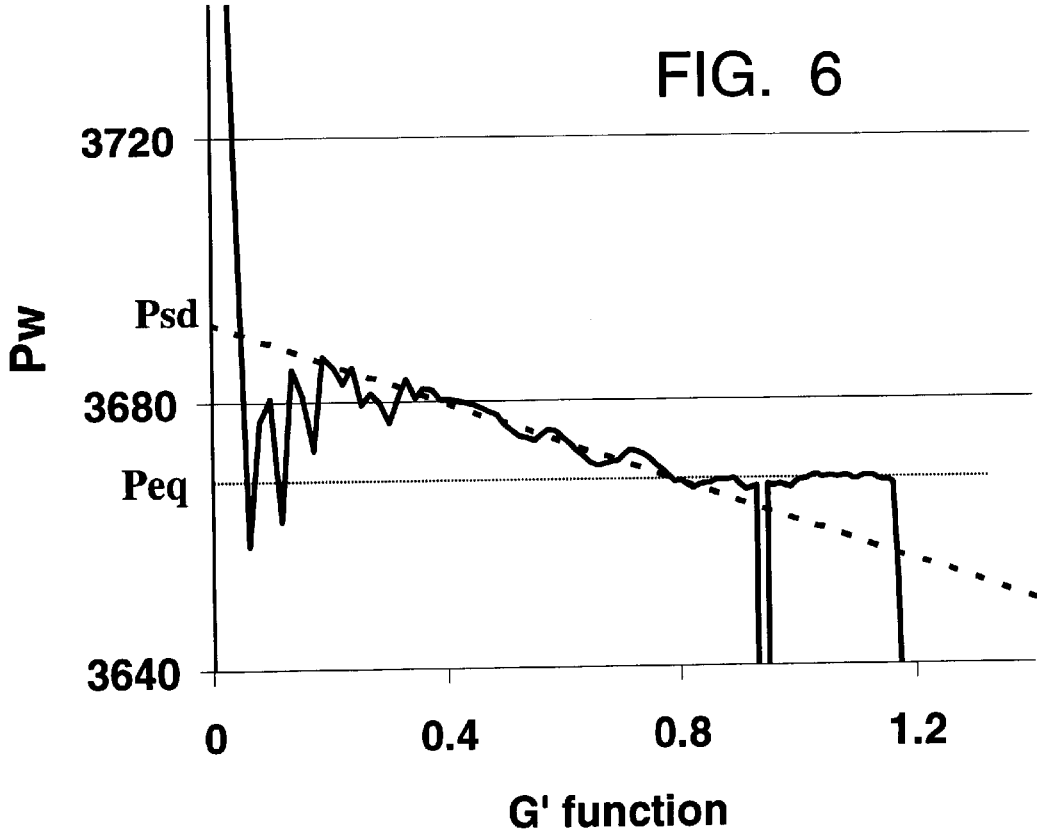
FIGS. 6 to 8 shows the wellbore pressure versus a modified G-function obtained by carrying out field tests.

During the equilibrium test, 20 lb/1000 gal linear guar is pumped at the main injection rate (Q) of 15 bpm before the rate drops to the small rate (q) of 1.67 bpm. The pump time at main injection rate is 4 minutes. The treating pressure flattens out 3 minutes after the rate step down. The pressure decline plotted as a function of the modified G-function, G', is shown in FIG. 6. The straight line corresponding to slope of the curve is shown in dotted line.

From the treating pressure, the following pressures are estimated:

| | |
|---|---|
| Psd | 3692 psi (value of the straight line for G' = 0) |
| Peq | 3665 psi (plateau at the end of the test) |
| ΔP at shut-in | 53 psi (obtained through a plot similar to FIG. 3) |

With hydrostatic pressure of 3991 psi, the closure pressure is calculated (using equations 6 and 8) to be Pc=7583 psi In comparison, the closure pressure determined from pressure decline after the equilibrium test shut-in and FET shut-in are approximately 7570 psi and 7683 psi, respectively. The G-function plot for the decline period of FET is shown in FIG. 6. The closure pressure determined from the FET is higher than that from the equilibrium test by about 100 psi. Similar increase in ISIP after FET as compared to the ISIP after the equilibrium test is also observed (an increase of about 150 psi). This increase could have been caused by poroelasticity effect. In spite of this, reasonably good agreement between the two methods is obtained.

Figure 5:
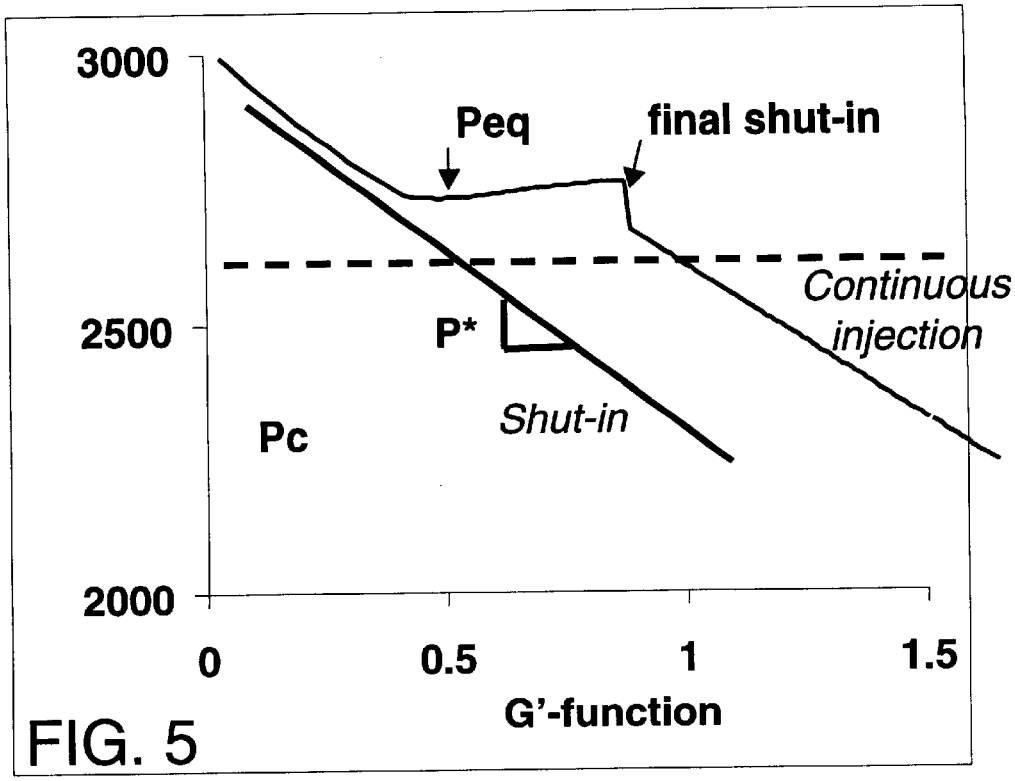
FIG. 5 shows the wellbore pressure versus a modified G-function in a continuous low-rate injection test according to the invention.

The pressure decline slope p* from FIG. 5 is 30 psi, which yields an efficiency of 44% (at the end of the main injection before the rate step down). In comparison, the analysis of pressure decline after FET yields a p* of 24 psi and efficiency of 55% for the FET.

Field Case #2

The formation being treated is a sandstone formation at depth of 5440'–5487' with net height of 38'. Formation permeability is 0.02 md. The treatment schedule consists of equilibrium test, FET and prop frac.

Figure 7:
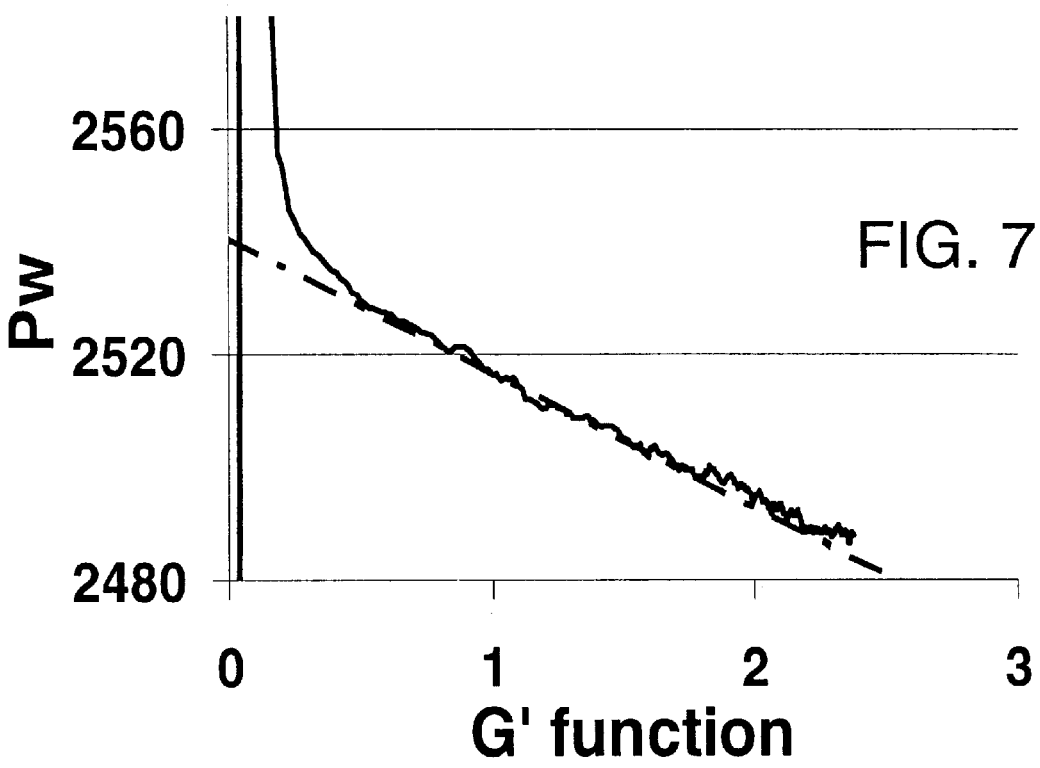

The main injection rate Q is 15 bpm and it drops to the small rate q of 1.16 bpm. The fluid used is 30 lb/1000 gal linear CMHPG. The pump time at the main injection rate is 3 minutes. Due to the low leak-off rate, the equilibrium is not reached until 16 min after the rate step down. FIG. 7 shows pressure vs. modified G-function, G'.

From the treating pressure, the following pressures are estimated:

| | |
|---|---|
| Psd | 2535 psi |
| Peq | 2487 psi |
| ΔP at shut-in | 104 psi |

Figure 8:
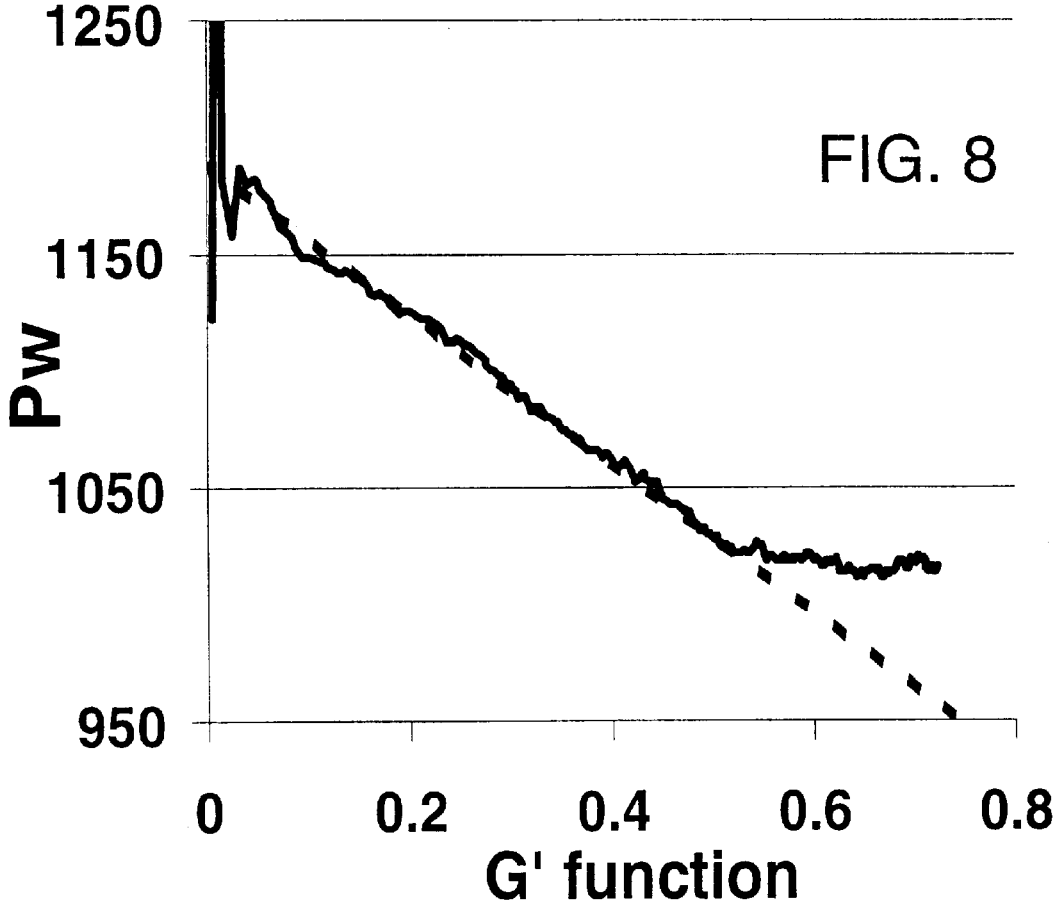

With hydrostatic pressure of 2370 psi, the closure pressure is calculated to be Pc=4710 psi In comparison, the closure pressure determined from pressure decline after the FET shut-in is approximately 4751 psi as shown in the G-function plot FIG. 8. The closure pressures estimated from the two methods agree well.

The pressure decline slope p* from FIG. 7 is 24 psi, which yields an efficiency of 67% (at the end of the main injection before the rate step down). In comparison, the analysis of pressure decline after FET yields a p* of 21 psi and efficiency of 60% for the FET.

Field Case #3

In this field case, the injection was not pumped for the purpose of closure pressure determination. Instead, the treatment consists of pumping a viscoelastic-based fluid prior to the main proppant fracturing fluid to place an artificial barrier at the bottom of the fracture to prevent downward height growth during the main fracture. The DivertaFRAC stage involves pumping the pad at a higher rate to create fracture length and then a slurry at a lower rate to allow sand to settle to build the barrier. By coincidence, this procedure is similar to the equilibrium test, and therefore the pressure record can be analyzed using the equilibrium test method to obtain an estimate of closure pressure.

The formation being treated contains sand/shale sequences at depth of 5544'. The target interval has a gross height of 60' and net height of 24'. The sand permeability is 33 md. The treatment schedule consists of pump-in #1, pump-in #2, pad, and the main frac. Pump-in #1 is an injection test that involves pumping 25 bbls of 2% KCl water at 12.6 bpm and then shut-in. Pump-in #2 consists of pumping 38 bbls of a mutual solvent at 3.2 bpm rate, followed by 13 bbls of 2% KCl water at 12.6 bpm rate (note: tubing volume is 53 bbls). The DivertaFRAC consists of 35 bbls of a 3% viscoelastic surfactant as pad, 28 bbls of 0.8% viscoelastic surfactant (with sand slurry), and 53 bbls of 2%

KCl flush, all at a rate of 12.6 bpm, followed by 35 bbls of 2% KCl over flush at 3.2 bpm rate. From the treating pressure and from the G' curve shown FIG. 8, the following pressures are estimated:

| | |
|---|---|
| Psd | 1182 psi |
| Peq | 1015 psi |
| ΔP at shut-in | 225 psi |

With hydrostatic pressure of 2433 psi, the closure pressure is calculated to be Pc=2901 psi In comparison, the closure pressures determined from pressure decline after pump-in #1, pump-in #2 and after shut-in of the DivertaFRAC are 2950, 3105 psi and 3130 psi, respectively. Again, the closure pressure from the equilibrium test agrees well with those from the shut-in decline.

The pressure decline slope p* from FIG. 8 is 320 psi, which yields an efficiency of 44% (at the end of the DivertaFRAC before over flush). In comparison, the analysis of pressure decline after pump-in #1 yields a p* of 325 psi and efficiency of 44%.

The equilibrium test can be combined with other injection tests, or any injection stage already planned for other purposes. For example, it can be combined with a step rate test. After stepping the rate up to the last rate, the rate is held constant for a period of time and then drops to the small rate q until the equilibrium is observed.

The equilibrium test can be used together with the conventional shut-in decline to provide an independent closure pressure estimate that helps identify the right closure point on the decline curve when multiple possibilities are present, or serves as the closure point when it cannot be identified from the decline curve. In the situations where minifrac is not conducted, the equilibrium test not only provides a closure pressure estimate, but also fluid efficiency estimate to help calibrate the treatment design.

What is claimed is:

1. A method of determining parameters of a full-scale fracture treatment of a subterranean formation having a closure pressure Pc comprising the steps of:

a) injecting a fluid into the formation at a generally constant first rate Q to create a fracture having a volume;

b) decreasing said injection rate to a second rate q, smaller than the first rate Q and such that the volume of the fracture becomes constant;

c) shutting-in the well;

d) monitoring the wellbore pressure during step a) to c);

e) determining the closure pressure Pc from the analysis of the wellbore pressure by using a time function of the dimensionless "shut-in" time $\Delta t_D$.

2. The method of claim 1, wherein said time function is a function of the square-root of the "shut-in" time $\Delta t_D$.

3. The method of claim 1, wherein said first injection rate Q is the expected full-scale fracturing rate.

4. The method of claim 1, wherein the ratio of said second injection rate q to said first injection rate is less than 0.2.

5. The method of claim 1, wherein the volume of fluid injected at a first rate Q is sufficient to form a fracture.

6. The method of claim 1, wherein the closure pressure test is carried out with a low viscosity fluid.

7. The method of claim 1, wherein said wellbore pressure has a friction component due to fracture tortuosity and tubing fiction, and wellbore includes tubing having a tubing friction component and further comprising an estimation of said friction component of the monitored wellbore pressure.

8. The method of claim 1, wherein in step e), the determination of the closure pressure Pc is made from the analysis of a G-function of the shut-in time.

9. The method of claim 1, wherein in step e), the determination of the closure pressure Pc is made from the analysis of a function equals to a G-function of the shut-in time minus a term equal to $$\frac{q}{Q}2\Delta t_D.$$

10. The method of claim 8, further including an estimation of the leak-off properties of the full scale fracture treatment.

11. A method of determining parameters of a full scale fracture treatment of a subterranean formation having a closure pressure Pc comprising the steps of:

a) performing a step-rate injection test to determine the matrix rate of the formation rate;

b) injecting a fluid into the formation at a generally constant first rate Q to create a fracture having a volume;

c) decreasing said injection rate to a feed rate q, smaller than the first rate Q but greater than the matrix rate determined in step a);

d) shutting-in the well;

e) monitoring the wellbore pressure during step a) to d);

f) determining the closure pressure Pc from the analysis of the wellbore pressure by using a time-function dimensionless "shut-in" time $\Delta t_D$.

12. The method of claim 11, wherein said time function is a function of the square-root of the "shut-in" time $\Delta t_D$.

13. The method of claim 11, wherein the fluid injected in steps b and c is a low viscosity fluid.

14. The method of claim 11, wherein said wellbore pressure has a friction component due to fracture tortuosity and tubing friction, and wellbore includes tubing having a tubing friction component, and further comprising an estimation of said friction component of the monitored wellbore pressure.

15. The method of claim 11, wherein in step f), the determination of the closure pressure Pc is made from the analysis of a G-function of the shut-in time.

16. The method of claim 11, wherein in step f), the determination of the closure pressure Pc is made from the analysis of a function equals to the G-function of the shut-in time minus a term equal to $$\frac{q}{Q}2\Delta t_D.$$

17. The method of claim 16, wherein the full scale fracture treatment has a leak-off and further including an estimation of the leak-off properties of the full scale fracture treatment.

* * * * *